US008517700B2

(12) United States Patent
Liberg

(10) Patent No.: US 8,517,700 B2
(45) Date of Patent: Aug. 27, 2013

(54) SUBMERSIBLE PUMP

(75) Inventor: Lars-Olof Liberg, Strömstad (SE)

(73) Assignee: GVA Consultants AB, Gothenburg (SE)

( * ) Notice: Subject to any disclaimer, the term of this patent is extended or adjusted under 35 U.S.C. 154(b) by 600 days.

(21) Appl. No.: 12/689,920

(22) Filed: Jan. 19, 2010

(65) Prior Publication Data

US 2010/0183455 A1 Jul. 22, 2010

Related U.S. Application Data

(60) Provisional application No. 61/145,763, filed on Jan. 20, 2009.

(30) Foreign Application Priority Data

Jan. 20, 2009 (SE) ..... 0950020

(51) Int. Cl.
*F04B 17/00* (2006.01)
*F04B 17/03* (2006.01)
*F04B 53/20* (2006.01)

(52) U.S. Cl.
USPC ..... 417/423.3; 417/386; 417/390; 417/555.2; 166/105; 166/105.1; 166/68

(58) Field of Classification Search
USPC ..... 417/386, 390, 410, 555, 2, 423.3; 166/68, 105, 105.1, 105.3, 106, 109, 110, 166/167, 169
See application file for complete search history.

(56) References Cited

U.S. PATENT DOCUMENTS

| | | | | |
|---|---|---|---|---|
| 4,317,485 | A * | 3/1982 | Ross | 166/216 |
| 4,425,965 | A * | 1/1984 | Bayh et al. | 166/106 |
| 4,877,353 | A * | 10/1989 | Wisotsky, Sr. | 588/17 |
| 5,000,264 | A * | 3/1991 | Snider | 166/372 |
| 5,452,992 | A * | 9/1995 | Kraus | 417/360 |
| 6,725,916 | B2 * | 4/2004 | Gray et al. | 166/68.5 |
| 2004/0007353 | A1 * | 1/2004 | Stave | 166/106 |
| 2008/0115927 | A1 * | 5/2008 | Unsgaard | 166/105 |

FOREIGN PATENT DOCUMENTS

| | | |
|---|---|---|
| EP | 0208035 | 1/1987 |
| GB | 1129432 | 10/1968 |
| GB | 2085078 | 4/1982 |

* cited by examiner

*Primary Examiner* — Peter J Bertheaud
*Assistant Examiner* — Dominick L Plakkoottam
(74) *Attorney, Agent, or Firm* — Gary M. Machetta

(57) ABSTRACT

The present invention relates to a submersible pump and a submersible pump system for pumping liquid to a marine structure, the pump being adapted to be located in a tube. The pump comprises an upper portion and a lower portion. The upper portion is adapted to be connected to means for suspending the pump in the tube. The pump has a vertical direction extending from the lower portion to the upper portion. The pump further comprises an inlet for allowing the liquid into the pump and an outlet for allowing the liquid out of the pump. The pump further comprises a sealing means located downstream of the inlet and the outlet in the vertical direction, the sealing means being adapted to seal against an inner surface of the tube. The invention further relates to an arrangement for hydraulic drive of the submersible pump and to a semi-submersible unit comprising the submersible pump system.

22 Claims, 12 Drawing Sheets

SUBMERSIBLE PUMP

CROSS REFERENCE TO RELATED APPLICATIONS

This application claims priority to Provisional Patent Application No. 61/145,763 which was filed on Jan. 20, 2009 and SE 0950020-8 which was filed on Jan. 20, 2009, the entirety of which is incorporated by reference herein.

BACKGROUND

1. Technical Field

The present invention relates to a submersible pump and a submersible pump system for a marine structure, such as a ship or a semi-submersible unit. The invention further relates to an arrangement for hydraulic drive of the submersible pump and to a semi-submersible unit comprising the submersible pump system. The described submersible pump may also be used in other appliances in which a liquid is to be pumped using a submersible pump.

2. Background of the Invention

A marine structure, such as a ship or a semi-submersible unit, uses sea water for a number of purposes for example in the ballast system, in the fire fight system and for sea water cooling systems. Generally, these systems comprise a plurality of tanks, which are adapted to be filled with sea water, i.e. water ambient of the marine structure, through a sea water system. The sea water system generally comprises several submersible pumps, so called primary pumps, for pumping up sea water above the sea water level to the marine structure. It further comprises tubes for transport of the sea water to tanks and/or to connecting tubes having booster pumps for further transport of sea water to the different users of the sea water system.

The primary pumps are sometimes subjected to service or need to be exchanged. At these occasions the pump has to be lifted up from its submerged pumping location to a service location above the sea water level. The transportation of the primary pump between a pumping location and a service location is a hazardous operation. There is a risk that a pump is unintentionally dropped due to incorrect handling of the lifting facilities and/or defects in the material of the lifting facilities. Often, the environment where these pumps are installed is exposed to difficult and extreme weather conditions which also may contribute to the risk scenario. A free falling pump may cause severe damages not only to the pump but also to equipment or installations on the marine structure or to human beings working there. Further, the dropping of a pump may also cause damages to sub-sea installations on the sea bed. Dropping a pump may also lead to time consuming and very costly reparation actions.

In view of the above, it may be realized that there is a need for improvements in the field of submersible pump for marine structures.

SUMMARY OF THE INVENTION

It is an object of the present invention to alleviate at least some of the above disadvantages and provide an improved submersible pump for a marine structure.

It is a further object of the invention to provide a submersible pump system for safe transportation and installation of a submersible pump at a pumping location as well as safe transportation of the pump to and from a pump service location.

According to a first aspect of the invention the object is achieved by a submersible pump for pumping liquid to a marine structure, the pump being adapted to be located in a tube. The pump comprises an upper portion and a lower portion. The upper portion is adapted to be connected to means for suspending the pump in the tube. The pump has a vertical direction extending from the lower portion to the upper portion. The pump further comprises an inlet for allowing the liquid into the pump and an outlet for allowing the liquid out of the pump. The pump further comprises a sealing means located downstream of the inlet and the outlet in the vertical direction, the sealing means being adapted to seal against an inner surface of the tube.

A submersible pump provided with a sealing means adapted to seal against an inner surface of the tube reduces the risk of severe consequences of a free falling pump. Accordingly, an improved submersible pump is provided in accordance with an object of the present invention.

According to some embodiments, the sealing means is a radial flange.

According to some embodiments, the sealing means is connected to the pump by means of a radial spring adapted to provide a resilient sealing against the inner surface of the tube.

According to some embodiments, the sealing means is provided with a downwardly oriented sleeve.

According to some embodiments, the angle between the pump and the sleeve is between 10° to 45°.

According to some embodiments, the outlet for allowing said liquid out of the pump is a radial outlet.

A further aspect of the invention relates to a submersible pump system, the system comprising a submersible pump according to the first aspect of the invention and a tube for transporting the pump to and from a submerged pumping location in a marine structure.

According to some embodiments, the pump further comprises a shock absorber being adapted to cushion the landing of the pump at the pumping location.

In case the pump reaches the pumping location with a moderate speed, i.e. after being dropped, the shock absorber receives at least some of the kinetic energy at the landing of the pump.

According to some embodiments, the tube further comprises a tube bottom plate being adapted to receive the pump in said pumping location.

When the pump has reached the pumping location the shock absorber cooperates with the bottom plate and seals the pump in the pumping location.

According to some embodiments, the pump is adapted to be locked from rotation in the pumping location by means of a locking arrangement. A first portion of the locking arrangement is connected to the tube at the pumping location and a second portion of the locking arrangement is connected to the pump.

The locking arrangement according to the above may omit the need for suspending the pump in a tubular assembly in order to prevent rotation of the pump in relation to the tube. This is particular advantageous for electrically driven pumps since the pump then can be supplied with energy from a flexible cable or similar.

According to some embodiments, the first portion of the locking arrangement comprises an arrangement of upwardly directed lumps. The arrangement of upwardly directed lumps is connected to the tube. Preferably, the lumps are connected to the tube bottom plate.

According to some embodiments, the second portion of the locking arrangement comprises a metal sheet arranged between the shock absorber and the pump and along the periphery of the pump. The metal sheet has an arrangement of downwardly inclined resilient lugs. The inclined resilient lugs will in use engage with the lumps so as to provide a rotational lock of the pump in relation to the tube.

According to some embodiments, a by-pass means is arranged around the lower portion of the pump at the pumping location, the by-pass means is adapted to allow the liquid provided from said outlet to pass the sealing means for further transport of said liquid.

According to some embodiments, the by-pass means is provided in the tube, whereby the tube at the pumping location has an inner diameter greater than the inner diameter of the tube portion above the pumping location to allow the flow of pumped liquid to by pass the sealing means in a by-pass chamber.

According to some embodiments, the by-pass means is a built-on chamber attached to the outside of the tube at the pumping location, whereby the tube has at least one opening for letting liquid out into said built-on chamber.

According to some embodiments, the tube is adapted to transport the pumped liquid from said pumping location up through the tube.

According to some embodiments, the system further comprises a lifting and lowering arrangement for transporting the pump to and from the pumping location.

By providing a lifting arrangement that is reliable and secure, the risk to drop a pump during transportation in the tube is reduced.

According to some embodiments, the lifting and lowering arrangement comprises at least one lifting wire and/or chain connected to the upper portion of the pump and connected to a winch located above the tube for transporting the pump up and down in the tube.

According to some embodiments, the lifting and lowering arrangement further comprises a control cable connected to the upper portion of the pump, said control cable houses an electrical cable for providing power to the pump. The control cable may also house additional connection means, for instance cables and/or flexible tubes, for instance for surveillance of the pump and/or supply of compressed air to the pump.

According to some embodiments, the lifting and lowering arrangement is installed in a pump room on board the marine structure.

A still further aspect of the invention relates to an arrangement for hydraulic drive of a submersible pump and a submersible pump system in accordance with the previous aspects of the invention, the arrangement comprises a hydraulic high pressure pipe adapted to lead hydraulic oil to the pump and a hydraulic low pressure pipe adapted to lead hydraulic oil in return from the pump. The arrangement further comprises an outer pipe surrounding the high pressure pipe and the low pressure pipe, wherein the outer pipe being adapted to accommodate a stationary cooling fluid for cooling the hydraulic oil when in use.

According to some embodiments, the hydraulic low pressure pipe is arranged around the hydraulic high pressure pipe.

According to some embodiments, the pressure of the cooling fluid in the outer pipe is lower than the pressure in the hydraulic low pressure pipe.

Another aspect of the present invention relates to a submersible pump system comprising a submersible pump and a tube assembly for transporting the pump to and from a submerged pumping location. The pump further comprises docking sealing means adapted to at least partially seal against an inner surface of the tube assembly. The tube assembly comprises a bottom member which in turn comprises a bottom opening through which at least a portion of the pump extends when the pump is in the pumping location. The bottom opening has a circumference being smaller than the circumference of the docking sealing means.

According to the present aspect of the present invention, the pump comprises a slide sealing portion adapted to at least partially seal against the bottom opening when the pump is moved towards the submerged pumping location such that a volume is delimited by the pump, the tube assembly, the docking sealing means and the slide sealing portion.

A further aspect of the invention relates to a semi-submersible unit, comprising a float, a deck structure, and at least one support column extending from the float to the deck structure, and further comprising at least one submersible pump according to the first aspect of the invention and/or a submersible pump system according to a further aspect of the invention for pumping sea water to the deck structure and/or an arrangement for hydraulic drive of a submersible pump.

According to some embodiments, the submersible pump system is arranged within at least one of the support columns of the semi-submersible unit.

BRIEF DESCRIPTION OF THE DRAWINGS

The present invention will hereinafter be further explained by means of non-limiting examples with reference to the appended figures wherein.

DETAILED DESCRIPTION OF PREFERRED EMBODIMENTS

The invention will be described using examples of embodiments. It should however be realized that the embodiments are included in order to explain principles of the invention and not to limit the scope of the invention, defined by the appended claims.

Figure 1:
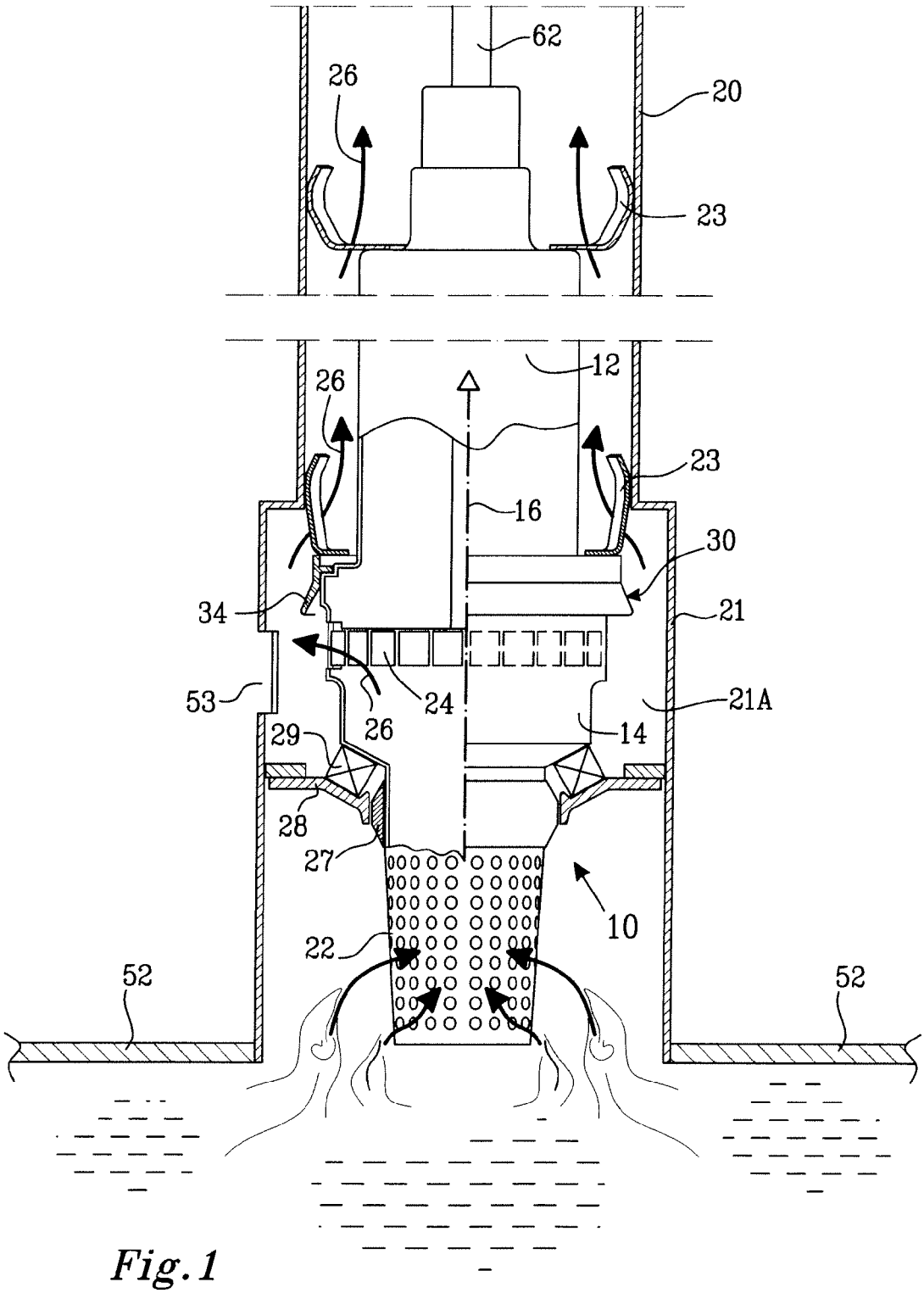
FIG. 1 illustrates a cross-sectional view of a submersible pump located in a tube according to one embodiment.

FIG. 1 illustrates a submersible pump 10 according to one embodiment; the submersible pump 10 comprises an upper portion 12 and a lower portion 14. The pump has a vertical direction 16 extending from the lower portion 14 to the upper portion 12. The upper portion 12 is adapted to be connected to means for suspending 62 the pump in a tube 20. In the upper portion 12 there is provided a driving means (not shown) for the pump 10. The lower portion 14 of the pump is provided with an inlet 22 for allowing liquid into the pump and an outlet 24 for allowing the liquid out of the pump. The pump inlet 22 is located in the end of the lower portion 14 of the pump. The pump outlet 24 is a radial outlet located around the circumference of the pump. Depending on the lifting height of the pumped liquid 26, the pump 10 is provided with one or two pump wheels in the lower portion of the pump. In FIG. 1, the inlet 22 is a strainer which is a preferred implementation of the inlet 22. However, in other embodiments of the pump 10, the inlet may 22 designed in other ways.

In some embodiments, the pump driving means is an electric motor. The motor is protected to overheating by means of circulating oil or circulating air preferably having a pressure higher than the pump pressure. The circulating oil or air is cooled by the pumping media/liquid surrounding the pump. Important functions of the pump are controlled via a control cable. The means for suspending the pump involves the control cable and a lifting wire and/or lifting chain.

In some embodiments, the pump driving means is a hydraulic driving means. The hydraulic driving means 70 will be described in more detail below in connection with FIGS. 6 and 7.

Figure 2:
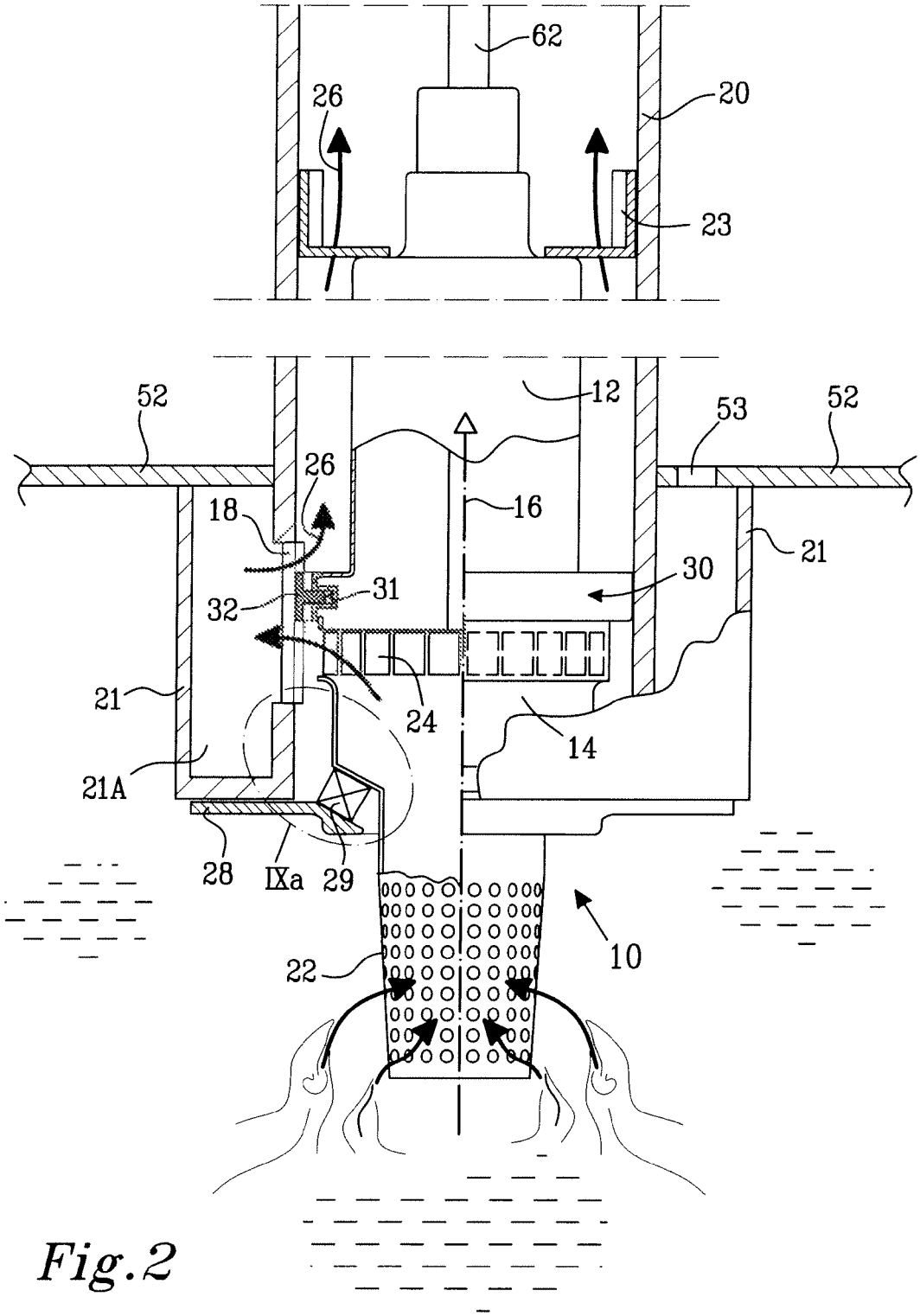
FIG. 2 illustrates a cross-sectional view of a submersible pump located in a tube according to another embodiment.

As illustrated in FIGS. 1 and 2, the submersible pump 10 is adapted to be located in a tube 20. Sealing means 30 are provided around the circumference of the lower portion 14 of the pump 10. The sealing means 30 is located downstream of, i.e. above the pump inlet 22 and downstream, i.e. above the pump outlet 24 in the vertical direction 16 of the pump. The sealing means 30 is adapted to seal against the inner surface of the tube 20. It is to be understood that the sealing means 30 may be arranged in such a way that there is a clearance between the sealing means and the inner surface of the tube to allow free movement of the pump up and down in the tube 20. In case the pump is unintentionally dropped on its way up or down in the tube, the sealing means 30 will slow down the speed of the falling pump 10. The sealing means reduces the upwardly directed flow of fluid, the fluid being air or liquid.

In some embodiments as for example illustrated in FIG. 2, the sealing means 30 may preferably be a radial flange 32. The radial flange 32 is resiliently mounted on the pump by means of a radial spring 31.

In the embodiment illustrated by FIG. 1, the submersible pump 10 is provided with a somewhat different sealing means 30. The sealing means comprises a downwardly oriented sleeve 34. The sleeve may preferably be made flexible. The sleeve 34 seals against the inner surface of the tube 20 against upwardly directed flow of fluid and will act as a parachute for the pump 10 in the tube in case the pump is dropped. This means that the flexible sleeve 34 provides an efficient seal against the inner surface of the tube 20. As the sleeve 34 is subjected to upwardly directed pressure, the angle between the pump 10 and sleeve 34 increases as the sleeve is moved out against the inner surface of the tube 20. The angle between the pump and the sleeve may vary between 10° to 45°. However, when the pump is lowered down in the tube at a low pace, the sleeve is expected to not to be forced towards the inner wall of the tube and therefore pumped liquid will pass by the sleeve. If necessary to enable the pump lowering, liquid may be supplied from top of the tube. When the pump is lifted up through the tube, the angle between the pump and the sleeve is reduced and no sealing effect is provided. This means that the pump 10 is smoothly lifted up through the tube 20.

The lower portion 14 of the pump is further provided with a shock absorber 29 arranged around the periphery of the pump. The shock absorber 29 is arranged below the outlet 24 but above the inlet 22. The shock absorber 29 may be conical or have a spherical surface shape. The shock absorber 29 has several functions, for example to cushion the shock in case of incautious but controlled lowering of the pump, to cushion the shock in case of a free falling pump, although slowed down, sealing against the bottom plate 28, and/or carrying the pump in the pumping location.

As illustrated in FIGS. 1 and 2, the submersible pumps are shown at a pumping location. In the submersible pump system a by-pass means 21 is arranged at the pumping location. The radial outlet 24 of the pump is located below the sealing means 30. Therefore, to allow the pumped liquid to pass the sealing means 30 the by-pass means 21 is provided at the pumping location. In FIG. 1 one embodiment of the by-pass means 21 is illustrated, whereby the tube 20 at the pumping location has an inner diameter greater than the inner diameter of the tube portion above the pumping location to allow the flow of pumped liquid to by pass the sealing means 30 in a pumping mode. The greater diameter of the tube ending provides a by-pass chamber 21A surrounding the outlet 24 of the pump 10.

In another embodiment shown in FIG. 2, the by-pass means 21 is a built-on chamber 21A attached to the outside of the tube 20 at the pumping location. To allow pumped liquid out into the built-on chamber the tube has at least one opening 18 for letting liquid out into the built-on chamber. Preferably, there may be a number of openings around the tube 20.

Figure 3:
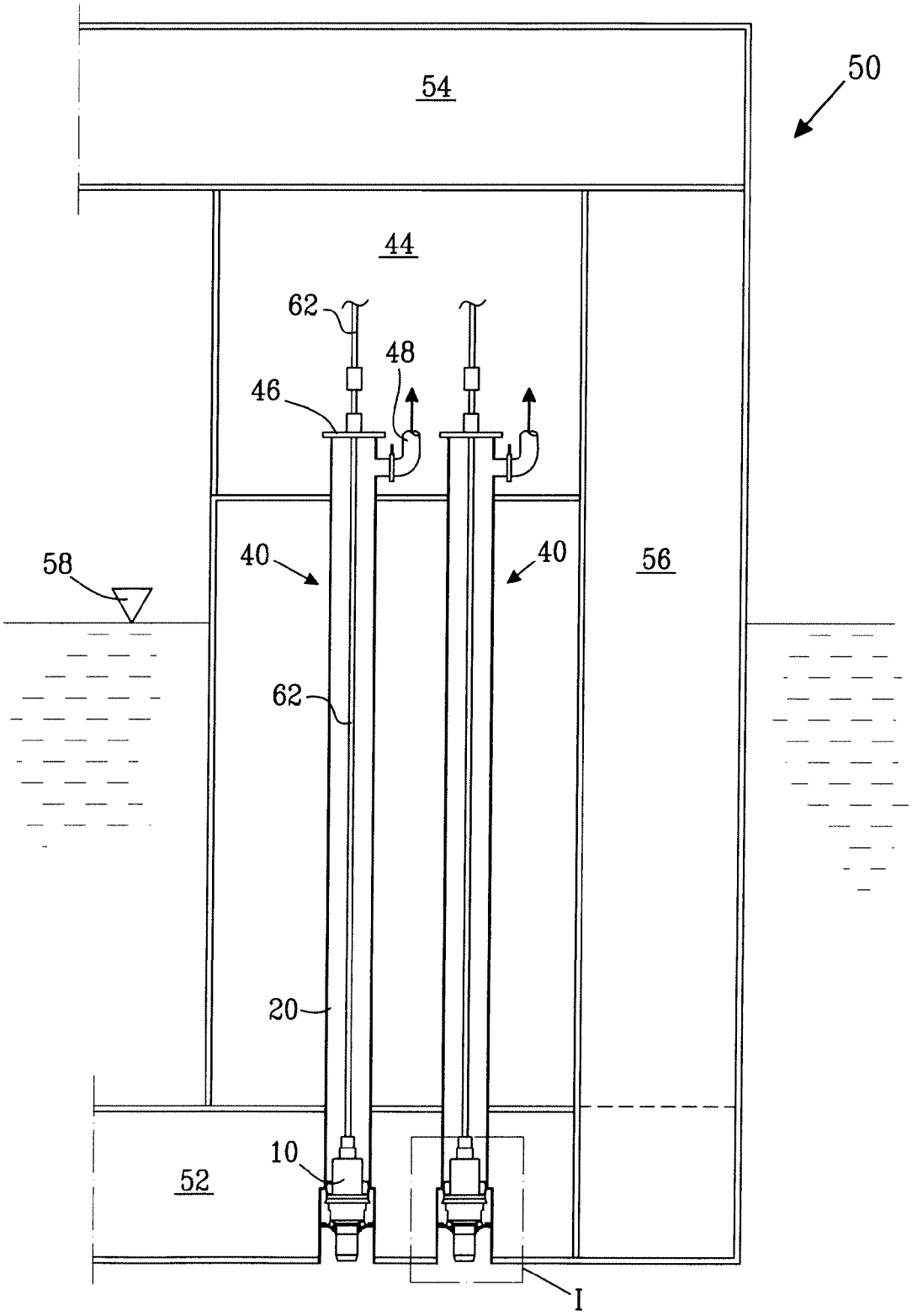
FIG. 3 illustrates a schematic cross-sectional side view of a portion of a marine structure, such as a semi-submersible ship, provided with a submersible pump system according to one embodiment.

FIG. 3 illustrates one embodiment of a submersible pump system 40 for a marine structure 50. In this case the marine structure is a semi-submersible unit 50. The submersible pump system 40 comprises a submersible pump 10 and a tube 20 for transporting the pump to and from a submerged pumping location. The submersible pump system 40 further comprises a lifting and lowering arrangement 60 for transporting the pump 10 to and from the pumping location. The lifting and lowering arrangement 60 is located in a pump room 44 on board the marine structure 50. The semi-submersible unit shown in FIGS. 3 and 4 comprises a float 52 having a horizontally extending centre plane, a deck structure 54 and at least one support column 56 extending from the float 52 to the deck structure 54. As the unit floats in water with a water surface 58, the float is adapted to be located at least partially beneath the water surface and the deck structure is adapted to be located at least partially above the water surface. The submersible pump system 40 according to FIG. 3 is arranged for hydraulic drive 70.

Figure 4:
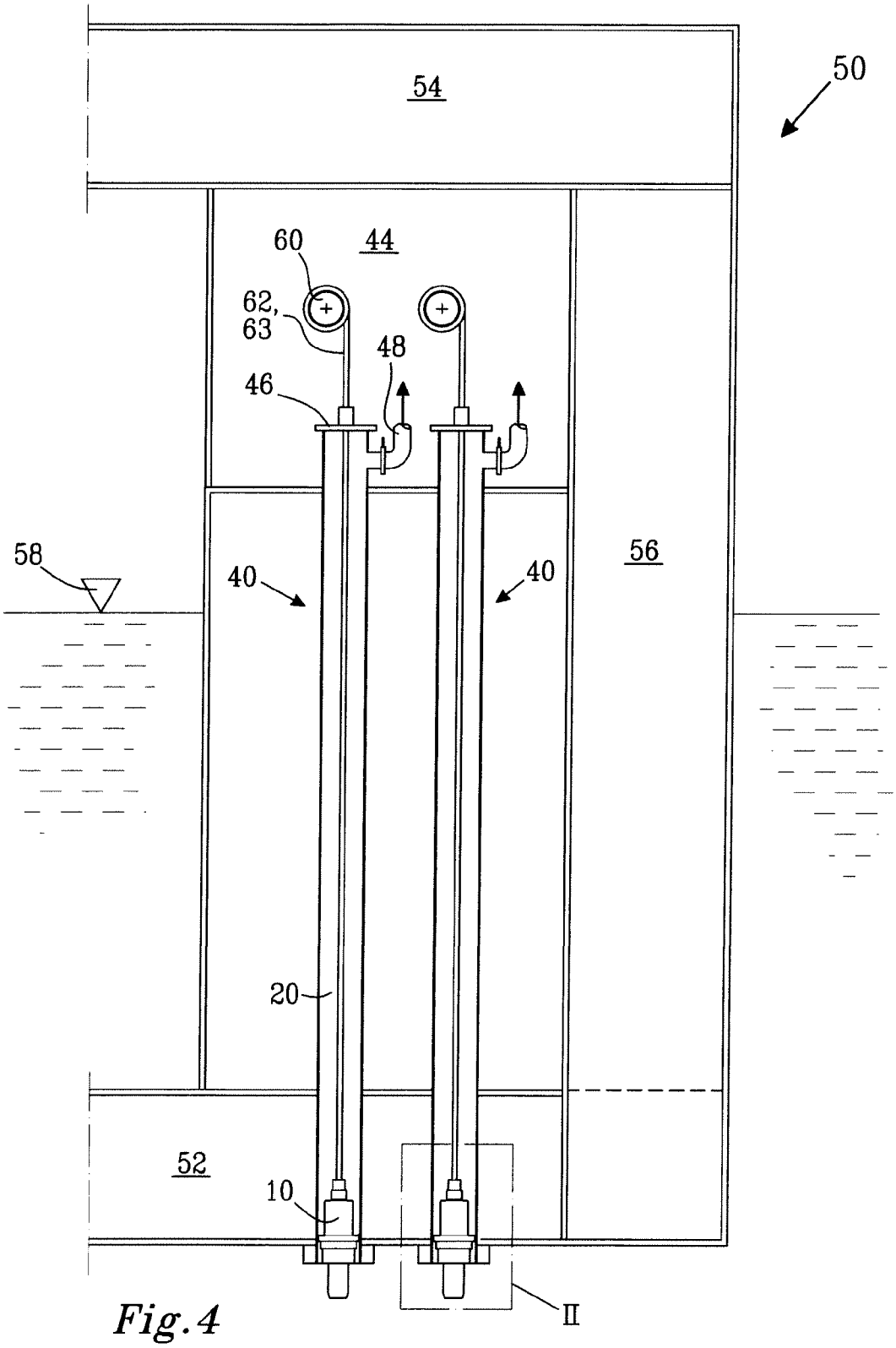
FIG. 4 illustrates a schematic cross-sectional side view of a portion of a marine structure, such as a semi-submersible ship, provided with a submersible pump system according to another embodiment.

FIG. 4 illustrates another embodiment of a submersible pump system for a marine structure, also in this case a semi-submersible unit. In the submersible pump system, liquid is pumped from a pumping location at the bottom of the float 52 with the inlet 22 of the pump slightly protruding under the float bottom 52. The submersible pump system 40 according to FIG. 4 is arranged for having an electric motor as driving means and for a lifting and lowering arrangement 60 illustrated in FIG. 5.

The tube 20 adapted for receiving the pump 10 may preferably be a circular and thick-walled tube. In some embodiments a caisson is used. The inner surface of the tube 20 should have a smooth inner surface. To protect the tube against corrosion the inner surface of the tube may be painted with an anti-corrosion paint. The inner diameter of the tube 20 is corrected to facilitate the lifting and lowering operations of the pump 10.

Preferably, the float 52 comprises a manhole 53 with a manhole cover (not shown) connecting the by-pass means 21 and the interior of the float 52. In the embodiment illustrated in FIG. 1, the manhole may extend substantially horizontally whereas the manhole in the FIG. 2 embodiment instead may extend substantially vertically. The manhole 53 may be used during inspection and/or maintenance of the by-pass means 21. As such, during inspection and/or maintenance, the opening in the float 52 to the ambient water is firstly closed, for instance from below by an additional cover (not shown). Purely by way of example, such a cover may be attached to the bottom plate 28. The water in the tube is then removed, for instance by using the pump 10, and the manhole cover is then opened such that an access to the by-pass means 21 is provided.

Turning again to FIGS. 1 and 2, the tube 20 is adapted to have a bottom plate 28 in its lowest end. In some embodiments, the bottom plate 28 has a central opening for receiving the inlet strainer 22 of the pump 10 such that the inlet strainer of the pump slightly protrudes from the tube opening. The bottom plate 28 is further adapted to receive the pump in the pumping location and seal against the shock absorber 29 after the pump has been winched down. The bottom plate 28 together with the shock absorber 29 is adapted to be a landing zone for the pump at the pumping location. The shock absorber 29 may preferably be in the shape of a massive, reinforced rubber ring. The shape of the shock absorber places the pump inlet 22 in the centre of the bottom plate 28 opening allowing a secure positioning in the pumping location. Further, there is at least one locating piece 23 helping to keep the pump into position. The locating pieces 23 further are useful for centering the pump in the tube 20 as the pump is transported in the tube. The bottom plate 28 and together with the shock absorber 29, prevent any flow of water into the tube 20 except through the pump inlet 22. The sealing effect between the bottom plate 28 and the shock absorber 29 on the pump is enforced when the pump is in use due to the raised liquid pressure inside the tube. The bottom plate 28 and/or the shock absorber 29 may preferably be made of or have a coating of a material resistant to marine fouling. An example of such a material is a copper alloy such as bronze.

In some embodiments, the inlet 22 of the pump 10 is kept within the tube 20 and therefore the bottom plate 28 is adapted to be arranged on the inside of the tube surface, see FIG. 1. Still there is a central opening in the bottom plate 28 for the pump to settle on when it reaches the pumping location.

Further, the bottom plate 28 may be attached to the tube 20 by means of an energy-absorbing screw joint reinforcement (not shown). In the case of a free falling pump, the pump has been slowed down by the sealing means 30 against the tube wall and when it reaches the tube, a cushioned landing is provided for by the bottom plate 28 and the shock absorber 29. A potential scenario with a free falling pump will be described in relation to FIG. 8.

Figure 9A:
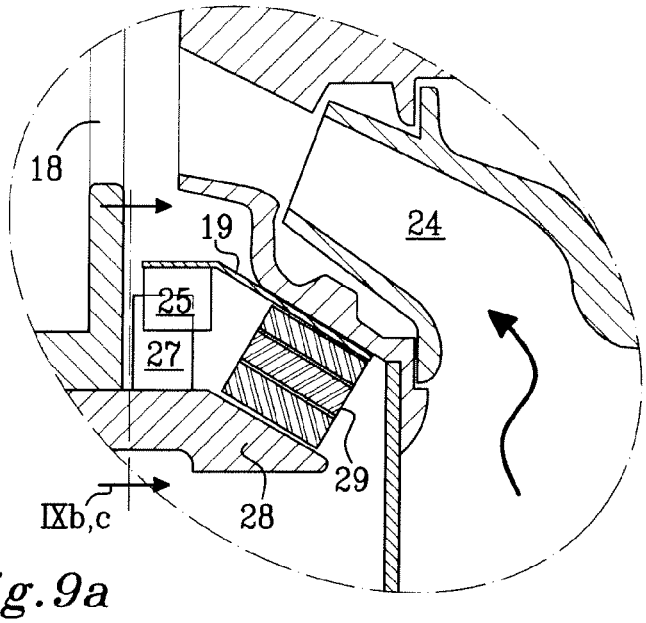
FIGS. 9*a*-9*c* illustrate a detail of the submersible pump system showing a locking arrangement.

In FIG. 9*a*, a detail from a submersible pump system is shown. Along the periphery of the pump 10, on a metal sheet 19 located between the pump 10 and the shock absorber 29, a number of axially and downwardly inclined resilient lugs 25 are arranged in the tangent plane. In the bottom plate 28 a corresponding arrangement of upwardly directed lumps 27 is provided. This arrangement provides a rotational lock preventing the outer parts of the pump to rotate in a direction opposite to the rotational direction of the pump motor. When the pump just has reached the pumping location, it is to be expected that the lugs 25 and the lumps 27 are not in engagement, see FIG. 9*b*. However, at the start of the pump, the outer parts of the pump will rotate in the opposite direction to the rotational direction of the pump motor whereby the lugs and lumps will engage into each other and prevent further rotation of the outer parts of the pump, see FIG. 9*c*. In this way, the position of the pump is secured in the pumping location.

Figure 9B:
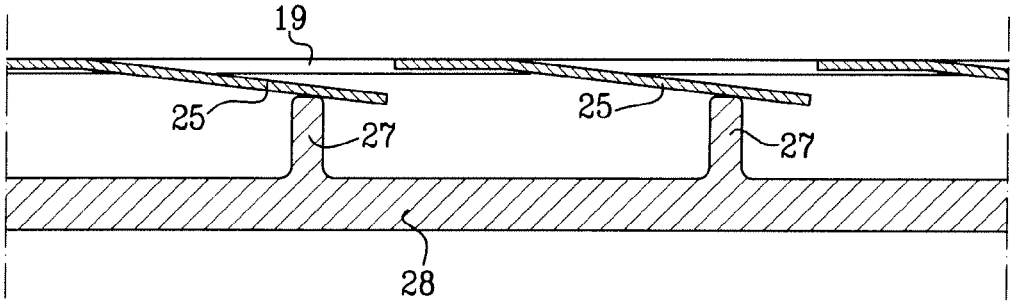
Figure 9C:
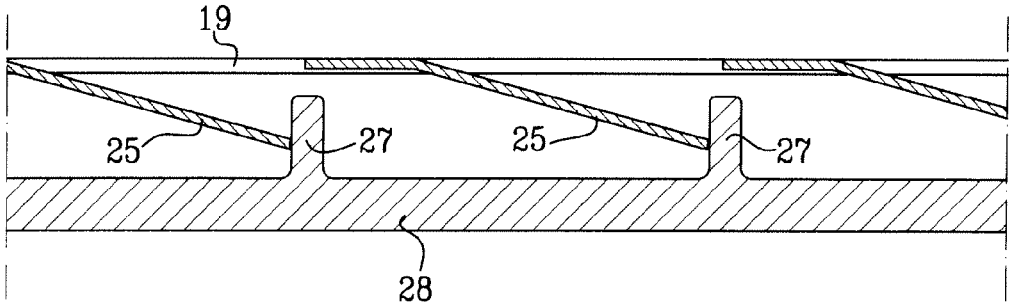
Figure 10:
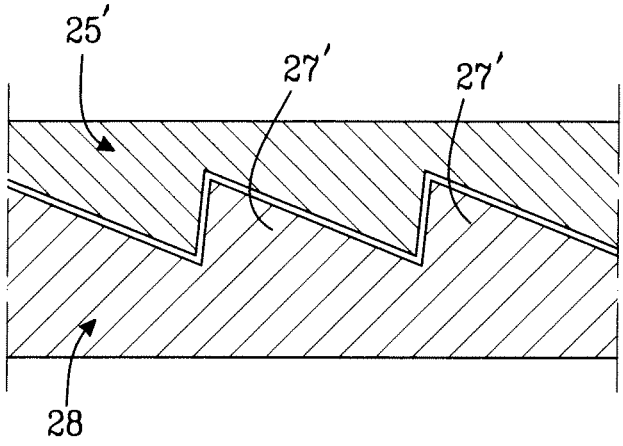
FIG. 10 illustrates a detail of the submersible pump system showing another locking arrangement.

FIG. 10 illustrates an alternative implementation of the locking arrangement illustrated in FIGS. 9A-9C. The FIG. 10 implementation comprises a set of substantially rigid saw-toothed portions having an upper part 25' which is attached to the pump and a lower part 27' which is connected to the tube 20, for instance via the aforementioned bottom plate 28 is indicated in FIG. 10. The upper and the lower parts 25', 27' engage so as to form a rotational lock of the pump 10 in relation to the tube 20.

At least one pump room 44 is arranged in the marine structure 50 for handling the submersible pumps, see FIGS. 3 and 4. In a semi-submersible unit the submersible pumps are arranged in at least two of the columns 56. Each pump room 44 may be located from approximately 5 m above the operational sea water level in a column 56 and up to the lower edge of the deck bow. Each primary pump 10 requires a tube 20 such that the pump can be transported to and from its pumping location. This tube may be a cylindrical caisson. The tube 20 extends from the floor of the pump room 44 down through the column to the bottom of the float 52. Each tube opening may be provided with protective cover 46 just above the floor level in the pump room. Each tube coming up through the floor in the pump room 44 has a connection tube 48 arranged to its side. The further transport of the liquid pumped by the submersible pump is taken care of by the connection tube 48.

In the case the pump together with the tube is used on a semi-submersible unit, the tube constitutes a part of the hull. It will also serve as a barrier against the surrounding sea. Further, the tube is used for transporting the pumped liquid, in this case sea water.

Figure 5:
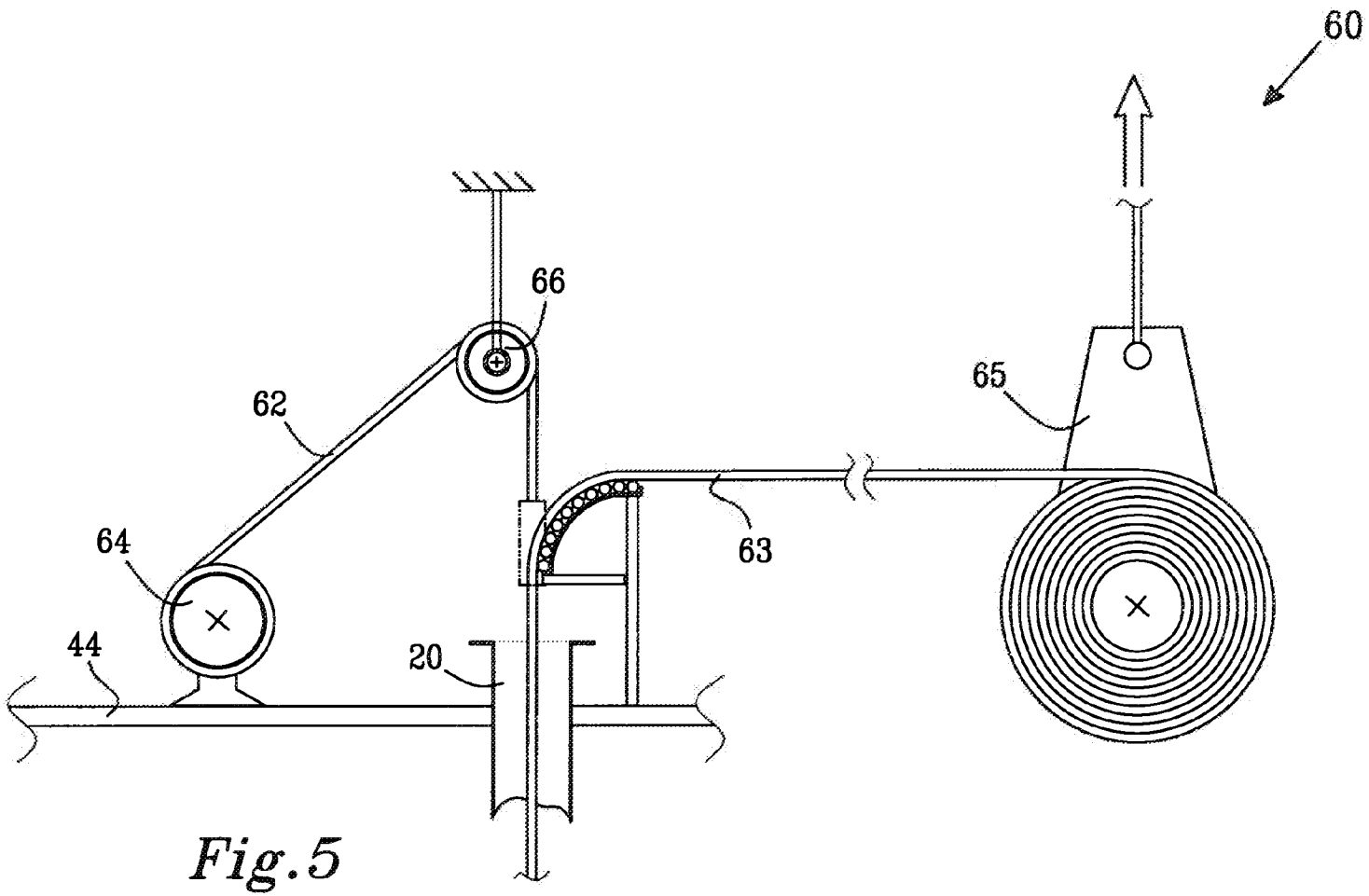
FIG. 5 illustrates a schematic cross-sectional view of a lowering and lifting device used in connection with a submersible pump system.

In the pump room 44, the lifting and lowering arrangement 60 is installed to allow transport of the pump 10 to and from a pumping location. FIG. 5 shows a schematic view of a lifting and lowering arrangement 60 for the submersible pump system 40. The lifting and lowering arrangement 60 is also used for other movements of primary pumps within the pump room. For example, a pump may be transported to a service location. The arrangement may also be used for replacing a defect pump with a new one. One or alternatively two lifting means 62 may be used to lift the pump up through the tube or to lowering it down to a pumping location. The lifting means 62 is also arranged to suspend the pump in the tube when the pump is installed in a pumping location. Inside the tube, the lifting wire is attached to a groove of the cover of a control cable. Under normal operation conditions, the lifting means has a certain tension such that the control cable is stabilized. The lifting means 62 may preferably be a lifting wire or a lifting chain.

It should be noted that in some implementations, the lifting and lowering arrangement 60 may be designed such that the lifting means 62 is released from the pump 10 after the pump has reached the pumping location. The lifting means 62 for instance wire or chain may thus be stored outside the tube 20 when the pump 10 is in the pumping location. Moreover, the lifting means 62 according to the above may also be used for lowering and/or lifting a plurality of pumps 10, one at a time.

A control cable 63 is provided in the pump room 44 and adapted to be attached to the upper portion of the pump and to follow the pump through the tube. The control cable cater for several functions in the pump, such as power supply to the pump motor through a three phase cable (or four phase), weak current cable for monitoring purposes, oil lines for lubrication and/or cooling purpose and a duct for the possibility of injecting a chemical treatment of the pumped liquid. Further, the control cable 63 may be provided with grooves for at least one lifting wire, a groove for a protective wire (not shown) and means for receiving locating pieces 23 along the control cable facilitating the orientation of the cable and the pump in the tube.

The protective wire is attached to the upper portion of the pump and extends along the control wire to the open end of the tube in the pump room. The protective wire is attached to several sacrificial anodes which serve as a part of the corrosion protection of the inside of the tube as well as for the equipment inside the tube. The protective wire itself serves as the ground connection for the sacrificial anodes. The location pieces for the control cable are fixed to the protective wire such the location pieces are placed in the correct positions. The location pieces 23 keep the control cable in the middle of the tube along its entire length.

Before lifting a pump up through the tube the lifting means 62 is connected to a winch 64 via a pulley wheel 66 suspended in an overhead crane 68 above the tube. The control cable 63 is unplugged in the pump room 44 and its end is connected to a cable drum 65. A separating tool is used to separate the control cable 63 from the lifting means 62 and to lead the control cable onto its cable drum 65 as the lifting wire is hoisted in. The winch 64 is manually operated and the operator watches over the equipment in the pump room as well as the tube 20 opening. As the primary pump is hoisted up the protective wire (not shown) is removed from its groove in the control wire 63 and locating pieces 23, which are used to locate the pump in the middle of the tube, are removed approximately at every 5 meters. When the primary pump reaches the pump room the lifting wire, protective wire and control cable are removed and the pump can now be transported away by the overhead crane to for example a service location. The tube opening is sealed with a covering lid.

For lowering a pump into the tube the same arrangement is used. For installation of a new pump or a pump returning from service, the lifting means 62, protective wire and control cable 63 are attached to the upper portion 12 of the pump 10. The lifting wire is coiled onto the winch drum 64 and the control cable 63 is coiled onto the control cable drum 65. The overhead crane 68 is used to lift the pump 10 into position above the tube opening. The separating tool used to separate the lifting wire from the control cable is now used to attach the lifting wire and the protective wire along the control cable. Locating pieces 23 are a connected to the control cable 63 approximately every 5 meters. When the pump reaches its pumping location it is guided into the right position. The wire winch is manually operated. The drive arrangement of the winch 64 comprises an irreversible worm gear with a brake for preventing the lifting means 62 from running of the drum and also if there is a failure in power supply to the pump. The lifting means drum may preferably be detachably mounted.

Figure 6:
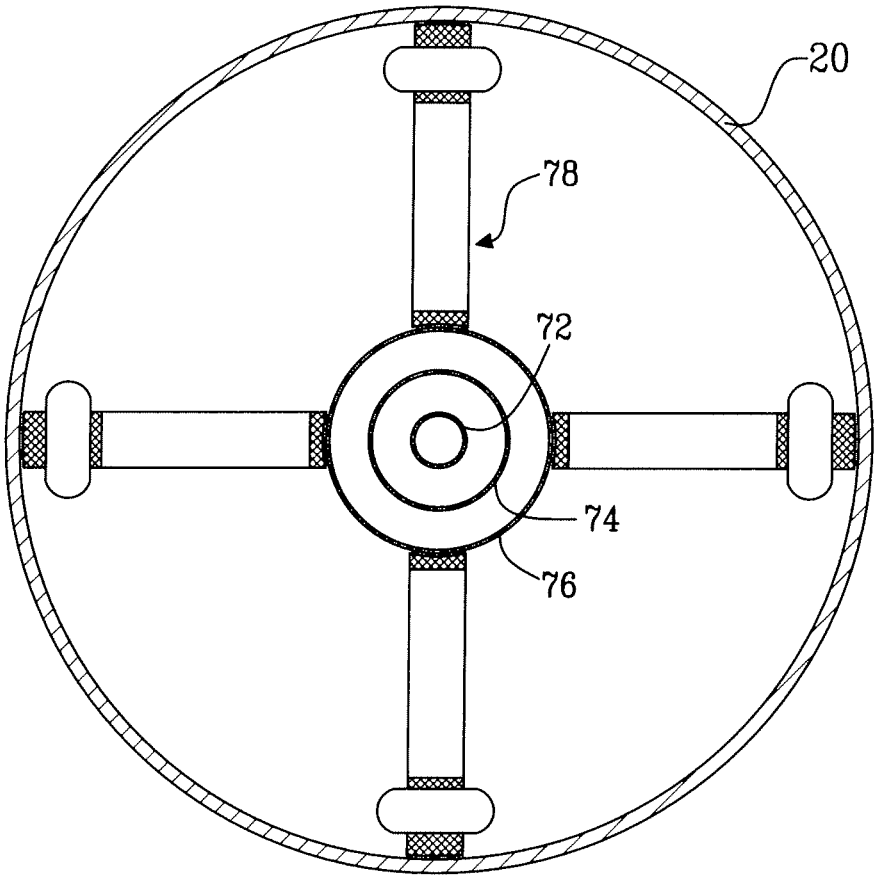
FIG. 6 illustrates a schematic cross-sectional view of an arrangement for hydraulic drive of a submersible pump.
Figure 7:
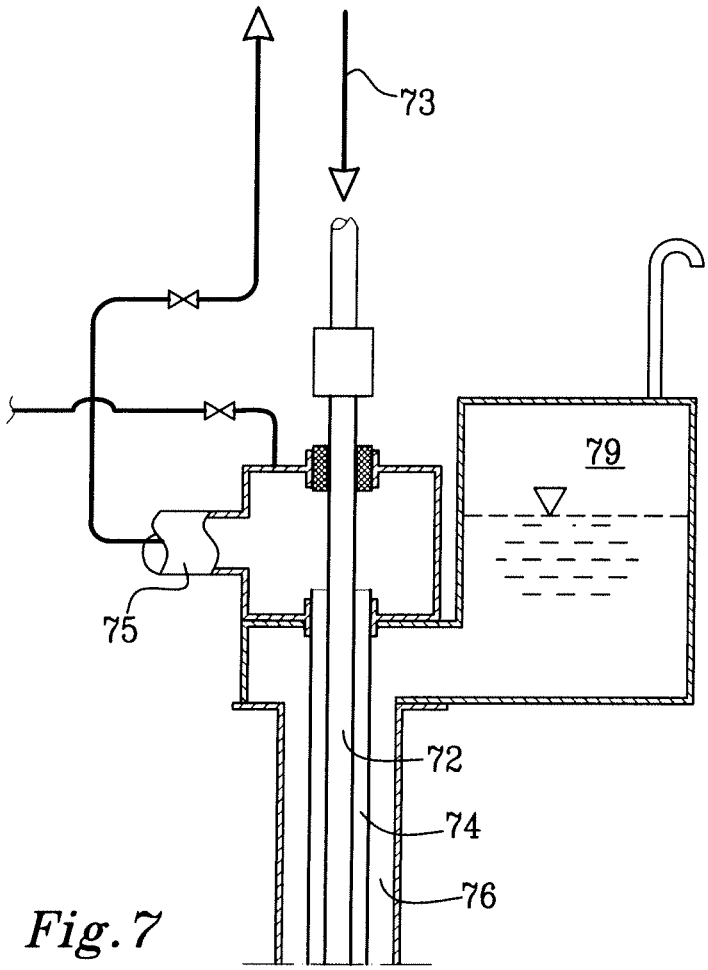
FIG. 7 illustrates a schematic side view of the arrangement for hydraulic drive of a submersible pump.

In FIG. 6, the hydraulic driving means 70 is schematically illustrated. It comprises hydraulic high pressure pipe 72 leading hydraulic oil to the pump and hydraulic low pressure pipe 74 leading hydraulic oil in return from the pump 10. An outer pipe 76, surrounding the high pressure pipe 72 and the low pressure pipe 74, is arranged for accommodating a stationary cooling liquid. The two hydraulic pipes may be concentrically arranged, i.e. the hydraulic low pressure pipe is surrounding the hydraulic high pressure pipe. The pressure in the cooling fluid in the outer pipe is lower than in the hydraulic low pressure pipe. This means that if a leak should occur in the hydraulic system, hydraulic oil will come out into the cooling liquid. The cooling liquid can thus not come into the hydraulic oil. The three pipes for hydraulic driving means are centred in the tube by locating arms 78. The cooling liquid inside the outer pipe 76 is in turn cooled by the liquid being pumped up through the tube 20. In FIG. 7, a reservoir 79 is shown, for supervision of the cooling liquid. The reservoir may preferably be arranged near the opening of the tube 20 in the pump room 44. The hydraulic system further comprises a return pipe 75 for the hydraulic oil leading the hydraulic oil back to the high pressure inlet 73.

Figure 11:
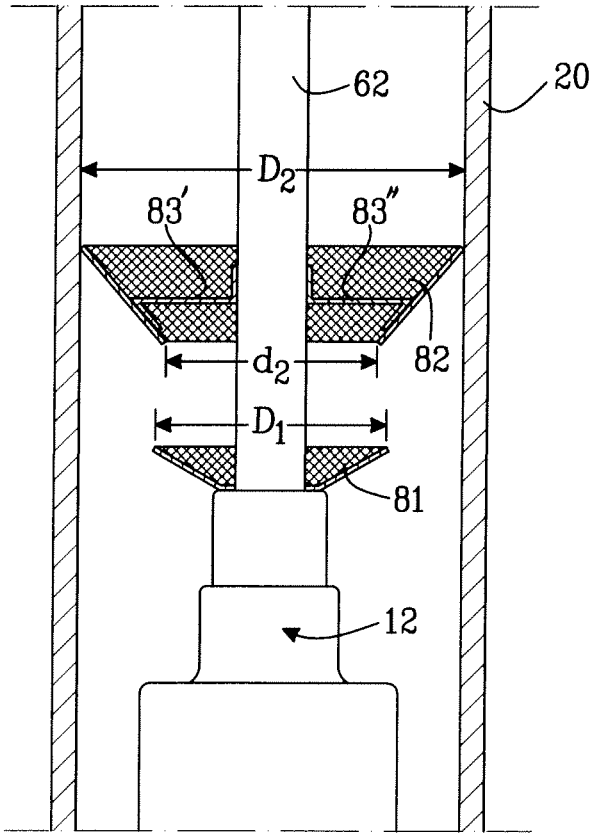
FIG. 11 illustrates a detail of the submersible pump system showing a collecting arrangement.

In FIG. 11, another detail from a submersible pump system is shown. As may be gleaned from FIG. 11, the submersible pump system comprises a collecting arrangement 80. The collecting arrangement 80 is preferably located by the upper portion 12, or above the upper portion 12, and preferably comprises a string or web basket adapted to cover the cross section of the tube 20. The purpose of the collecting arrangement 80 is to collect objects which may be dropped in the tube 20, for instance during lowering and/or raising operations of the pump 10. The collecting arrangement 80 may in some implementations, as illustrated in FIG. 11, comprise a first and a second basket 81, 82 wherein the first basket 81 is located below the second basket 82. The first basket 81 has an outer diameter $D_1$ which is smaller than the diameter of the tube 20. The second basket 82 is bottomless and preferably has a outer diameter $D_2$ which is substantially equal to the diameter of the tube 20, an inner diameter $d_2$ which is equal to or slightly smaller than the outer diameter $D_1$ of the first basket 81. The second basket 82 is preferably connected to the suspension means 62, or a portion of the pump 10 located above the first basket 81, by means of one or more connecting arms 83', 83".

As such, if an object (not shown)—such as a tool—is dropped in the tube 20, the tool will either hit the first 81 and/or the second basket 82. If the tool hits the second basket 82, the tool will fall through the second basket 82 and be redirected to the first basket 81 due to the shape of the second basket 82, i.e. due to the inclined surface of the second basket 82. It should be noted that the second basket 82 may be used as a locating arrangement, similar to the locating arms 78 discussed hereinabove with reference to FIG. 6. The second basket 82 may preferably be made of a carbon fibre reinforced plastic material. The collecting arrangement 80 may be a fixed part of the pump 10. Optionally, the collecting arrangement 80 may be releasably attached to the pump 10 and/or the suspension means 62 such that the collecting arrangement 80 is present only when operations are performed which may result in a dropped object.

Figure 8:
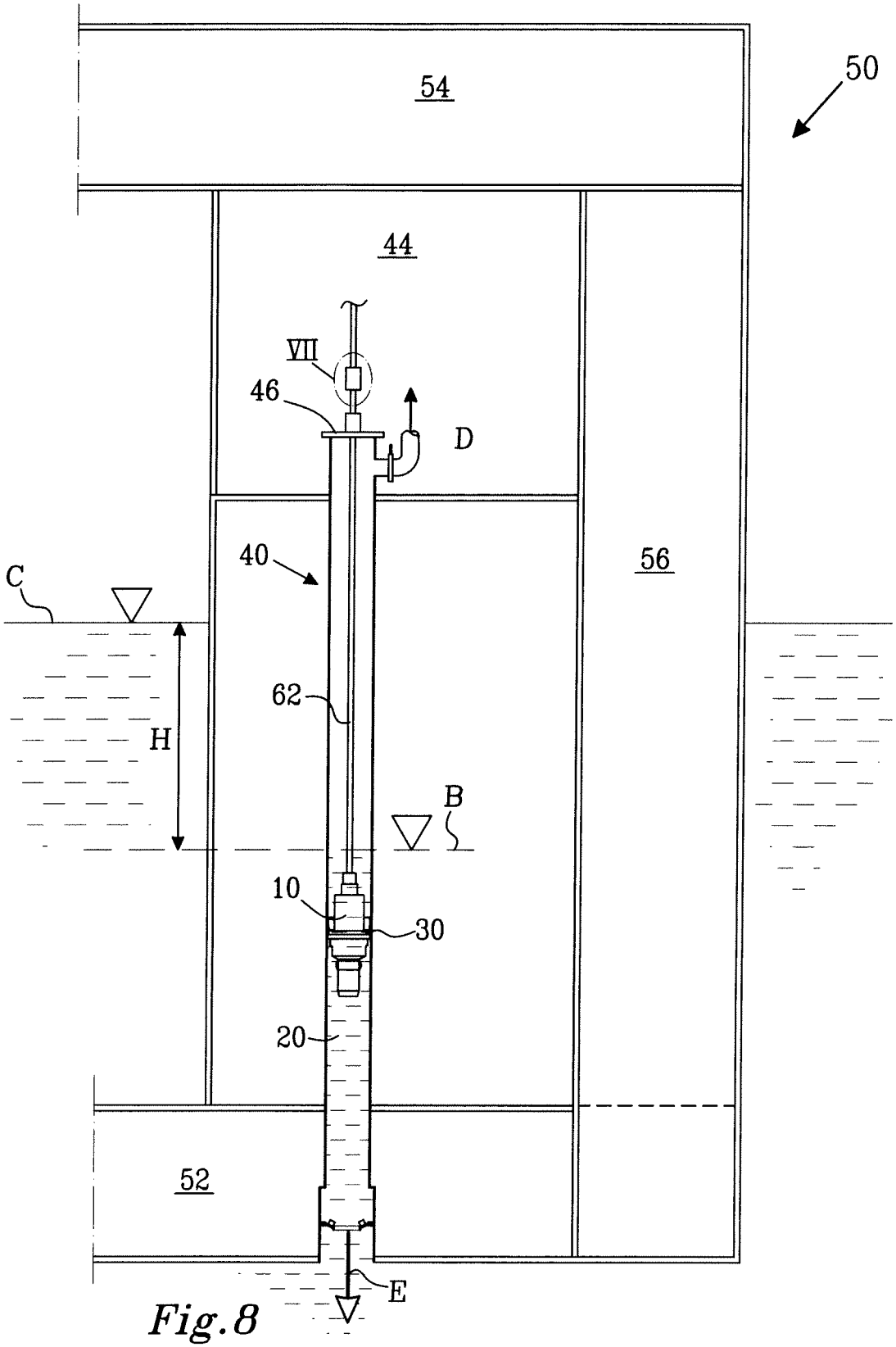
FIG. 8 illustrates a schematic view of a dropped pump scenario.

Turning now to FIG. 8, a potential scenario with a free falling pump will be described. A pump 10 is on its way up to level D when for example the lifting means suddenly fails. At the time of the event, the water level in the tube 20 was at the level indicated with C.

As the pump 10 is falling, the air in the tube 20 between level D and level C is compressed between the sealing means 30 of the pump and the sinking water level. Water is pressed out at level E due to the pressure caused by the falling pump.

The free fall of the pump is reduced by the rapidly compressed air. The outflow of water is rapid but is somewhat reduced by the constriction caused by the bottom plate 28 in the tube 20.

The moment illustrated in FIG. 8 shows that the fall of the pump has almost stopped. The compressed air has leaked passed the sealing means 30 and also some water has passed the sealing means, such that there is now some water above the pump. Equilibrium is reached and water is no longer flowing out at level E. The amount of discharged water represents the height H multiplied by inner tube area and the volume of the pump. The weight of the discharged water corresponds to the weight of the pump. Now the pump will sink further down in the tube at a rate decided by how much water may pass by the sealing means 30.

When the pump reaches the level for the by-pass arrangement 21 around the pumping location, the sealing means 30 no longer has effect and the pump will fall through the water and is landing with the shock absorber 29 onto bottom plate 28 at the pumping location. Preferably, this last distance is not more than approximately 10 cm.

Figure 12A:
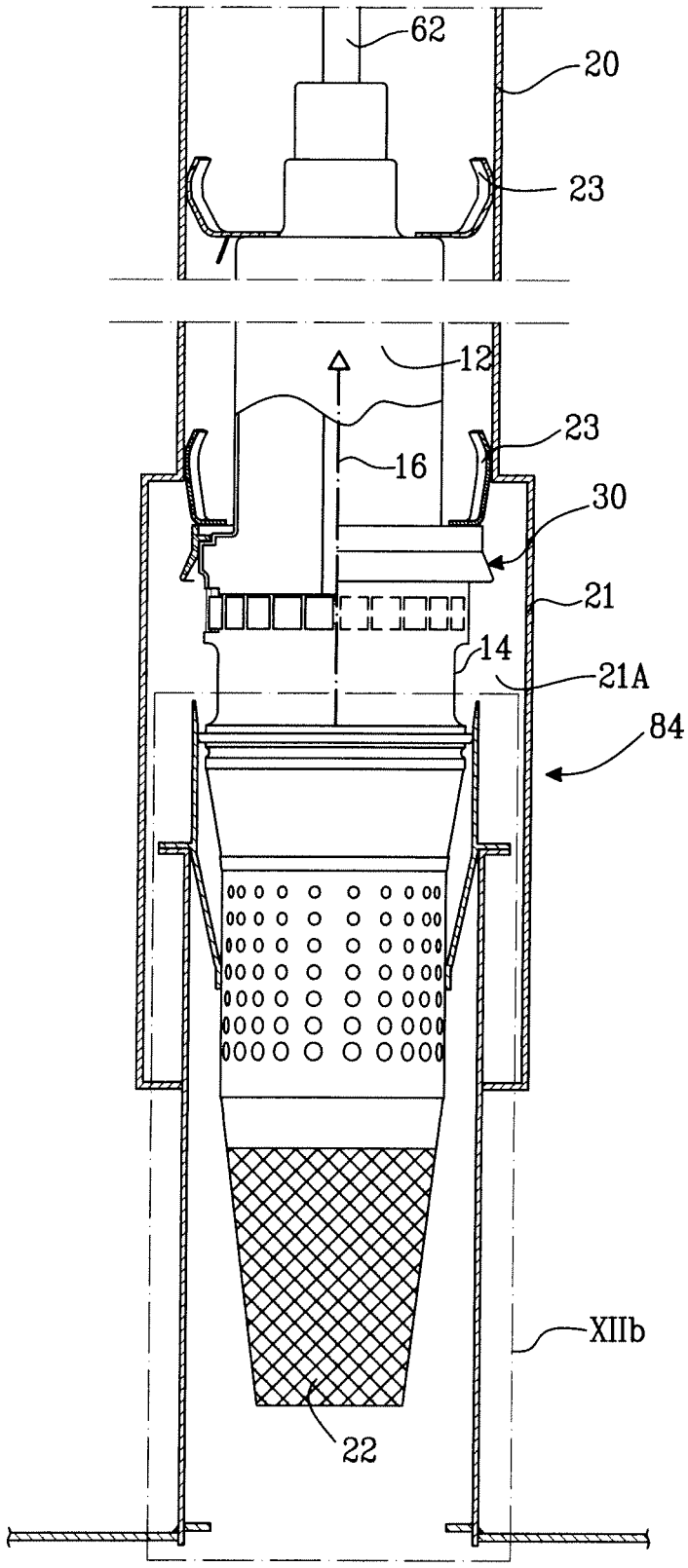
FIG. 12*a*-*b* illustrate a further aspect of the present invention.
Figure 12B:
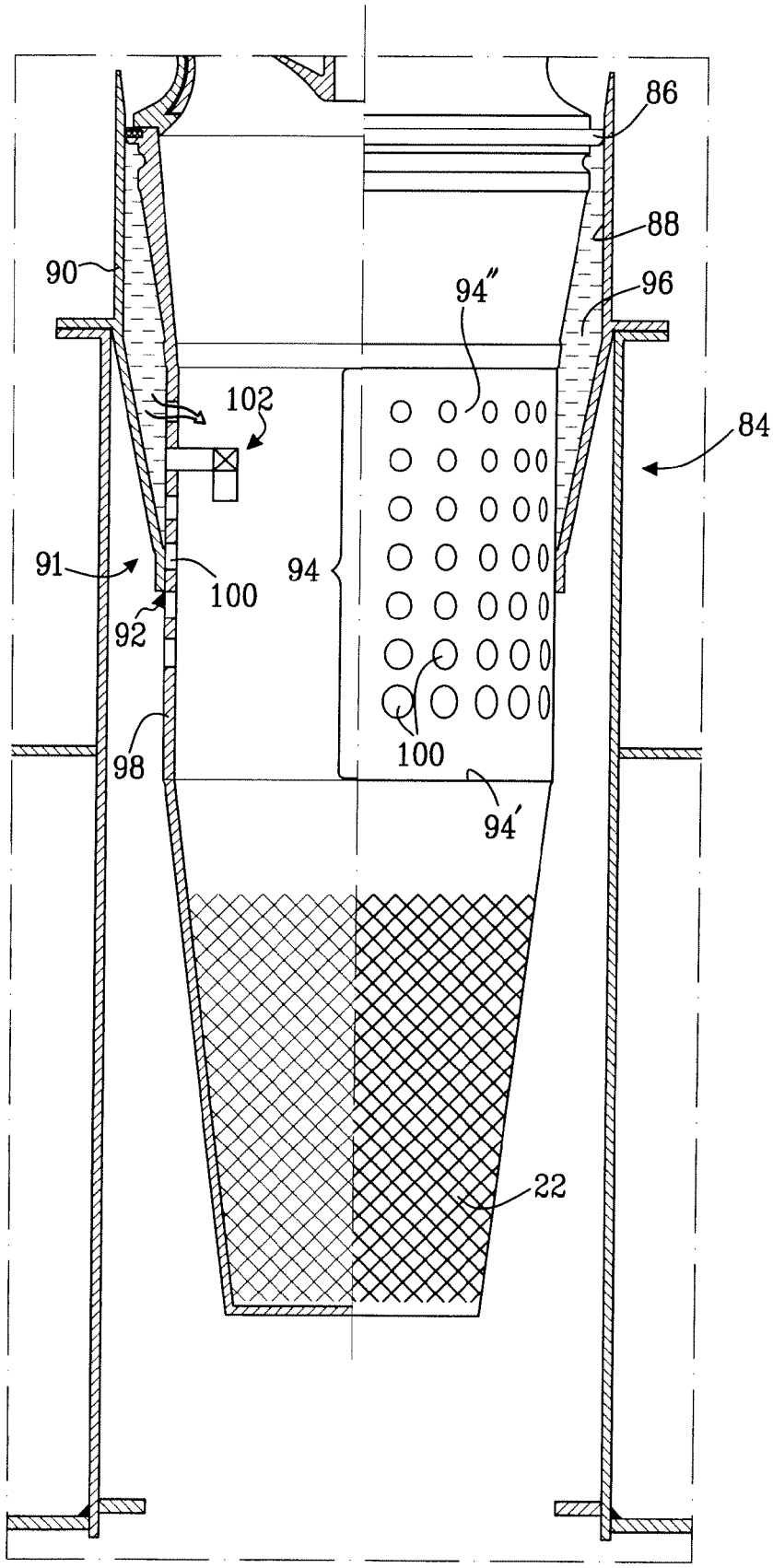

FIG. 12*a* and FIG. 12*b* illustrate another aspect of the present invention. The FIGS. 12*a* and 12*b* embodiment of this aspect comprises a sealing means 30 which has been discussed hereinabove which is a preferred embodiment of the present aspect of the invention. However, it should be noted that the aspect of the present invention illustrated in FIGS. 12*a* and 12*b* may also be used for pumps 10, as well as systems comprising a pump 10 and a tube 20, which does not comprise the above-mentioned sealing means 30.

The FIG. 12 aspect of the present invention may reduce the risk of severe consequences of a free falling pump, in particular if the pump is dropped at a low elevation, e.g. only a few meters above the submerged pumping location of the pump 10 in relation to the tube assembly 84. Moreover, the FIG. 12 aspect of the present invention may provide that the last stage of the transport of the pump 10 to the submerged pumping location, which last stage may be referred to as landing or docking of the pump, may be performed in a controlled manner and preferably without imparting excessive impact loads on either the pump 10 or the tube assembly 84. FIG. 12 illustrates the embodiment of the present invention in a position wherein the pump 10 is close to, but has not yet reached, its submerged pumping location.

FIG. 12*b* illustrates a system comprising a pump 10 and a tube assembly 84 which tube assembly 84 comprises a tube 20. The FIG. 12*b* pump 10 comprises a docking sealing means 86 adapted to at least partially seal against an inner surface 88 of the tube assembly 84. In the embodiment illustrated in FIG. 12*b*, the inner surface 88 is located on a docking sleeve 90 fixedly attached to another portion of the tube assembly 84, for instance by means of a bolt or weld joint (not shown in FIG. 12*b*). The docking sleeve 90 may preferably be mounted from a manhole (not shown) with a sealing block (not shown). As may be gleaned from FIG. 12*b*, the docking sleeve 90 may preferably comprise a tapered portion 91 such that the circumference of the docking sleeve 90 increases along an upward direction, i.e. in a direction in which the pump 10 is transported from the pumping location in the tube assembly 84.

The tube assembly 84 comprises a bottom member which in FIG. 12*b* is implemented as the above-mentioned docking sleeve 90. However, in other embodiments of the FIG. 12*b* aspect of the present invention, the bottom member may be a substantially horizontally extending plate (not shown in FIG. 12*b*) similar to the one illustrated in FIG. 1 with reference sign 28. The bottom member comprises a bottom opening 92 through which at least a portion of the pump 10 extends when the pump 10 is in the pumping location. The bottom opening 92 has a circumference which is smaller than the circumference of the docking sealing means 86. In the embodiment illustrated in FIG. 12*b*, both the docking sealing means 86 and the bottom opening 92 have circular cross-sections but in other embodiments, at least one of these cross-sections may have another shape, such as an oval or polygonal shape for instance.

As may be gleaned from FIG. 12*b*, the pump 10 further comprises a slide sealing portion 94 adapted to at least partially seal against the bottom opening 92 when the pump 10 moves towards the submerged pumping location. When the slide sealing portion 94 seals against the bottom opening 92, a volume 96 is delimited by: the pump 10, the tube assembly 84, the docking sealing means 86 and the slide sealing portion 94. In the embodiment illustrated in FIG. 12*b*, a volume is actually delimited by: the pump 10, the inner surface 88 of the docking sleeve 90, the docking sealing means 86 and the slide sealing portion 94. Since the pumping location of the pump 10 is submerged, the volume 96 is filled with sea water. Thus, once the volume 96 is formed, due to the low compressibility of sea water, any further downward movement of the pump 10 in relation to the pump assembly 84 is practically prevented.

However, in order to allow a controlled downward movement of the pump 10 from the position illustrated in FIG. 12*b*, which downward movement is desired in order to put the pump 10 in the pumping location, the pump 10 and/or the tube assembly 84 preferably comprises fluid communication means adapted to provide a volume fluid communication between the volume 96 and the internal and/or external environment ambient of the volume 96. Such fluid communication means may be referred to as a volume fluid communication means.

Such means may be obtained in a plurality of ways. As a first example, a portion of the tube assembly 84, such as the docking sleeve 90, may be provided with a plurality of openings (not shown in FIG. 12*b*) allowing sea water in the volume 96 to be evacuated to the ambient environment.

However, from inter alia a maintenance point of view, it may be preferred to provide the pump 10 with the volume fluid communication means. Implementations of pumps 10 with such volume fluid communication means are presented hereinbelow.

As a first implementation of the volume fluid communication means, reference is made to FIG. 12*b* which illustrates that the slide sealing portion 94 comprises a hollow member delimited by a slide sealing portion wall 98 and the volume fluid communication means comprises a plurality of openings 100 extending through the slide sealing portion wall. Preferably, the cross sections of the openings 100 may vary such that the cross section of an opening 100 located in the upper portion 94" (i.e. closest to the docking sealing means 86) of the slide sealing portion 94 is smaller than the cross-section of an opening 100 located in the lower portion 94'.

One advantage of having openings 100 with varying cross-sections is that a relatively large total cross-sectional area (i.e. the aggregate of the cross-sectional areas of at least a plurality of the openings 100) of the volume fluid communication means is obtained during an early stage of the landing or docking of the pump 10. The relatively large total cross-section area will provide a relatively large flow of sea water from the volume 96 to the ambient environment which will thus only to a low extent reduce the vertical velocity of the pump 10 in relation to the pump assembly 84. As the pump 10 approaches the pumping location, the total cross-section area will be reduced, because of the reduced number of openings connecting the volume 96 with the ambient environment and also because the openings are smaller in the upper portion 94" of the slide sealing portion 94. Due to the small total cross-sectional area, the vertically velocity of the pump 10 will be significantly reduced when the pump 10 is close to its pumping location which provides a smooth landing or docking of the pump 10 into position.

Instead of, or in addition to, the openings 100 previously discussed, the volume fluid communication means may comprise an overflow valve 102 adapted to provide the volume fluid communication when a fluid pressure in the volume exceeds a predetermined level. Purely by way of example, the overflow valve may be designed so as to provide the aforesaid fluid communication when the pressure in the volume 96 exceeds 20 bars.

Instead of, or in addition to, one or both of the two implementations of the volume fluid communication means, the means may be obtained by letting the slide sealing portion 94 comprise a tapered portion (not shown in FIG. 12*b*) such that a sealing gap between the bottom opening 92 and the slide sealing portion 94 decreases, continuously and/or in a stepwise manner, as the pump 10 moves towards the submerged pumping location. As used herein, the expression "sealing gap", relates to the area of the cross-section of the gap between the slide sealing portion 94 and the bottom opening 92. Preferably, the sealing gap between the bottom opening 92 and the lower portion 94' may be in the range of 100-10, preferably 70-30, times greater than the sealing gap between the bottom opening 92 and the upper portion 94". Moreover, the sealing gap between the bottom opening 92 and the lower portion 94' may be within the range of 0.1 to 0.03, preferably within the range 0.07 to 0.04, of the cross-sectional area of the bottom opening 92. Purely by way of example, for a tube assembly 84 having a circular bottom opening with a diameter of 0.6 m, the radial gap between the bottom opening 92 and the lower portion 94' may be 0.01 to 0.005 m, decreasing to a radial gap in the range of 0.0002 to 0.0001 m between the bottom opening 92 and the upper portion 94". The vertical distance between the upper and lower portions may be in the range of 1 to 0.5 times the diameter of the bottom opening 92. Again, purely by way of example, for a tube assembly 84 having a bottom opening diameter of 0.6 m, the distance between the upper and lower portions 94", 94' may be within the range of 0.6 to 0.3 m and may preferably be approximately 0.4 m. Purely by way of example, the above variation in sealing gap may be obtained by a slide sealing portion 94 having a frusto-conical outer surface (not shown).

As previously discussed, it is preferred, although not required, that a pump 10 comprises the aforementioned sealing 30 as well as the docking sealing means 86 and the slide sealing portion 94. This is since this combination provide that the reduction of the risk of severe consequences of a free falling pump is further reduced since the sealing 30 will reduce the risk for consequences if the pump 10 is dropped from a large vertical distance relative to its pumping location whereas the docking sealing means 86 and the slide sealing portion 94 will preferably provide a low risk for consequences if the pump is dropped from a small vertical distance, e.g. from 3-5 meters above the pumping location.

It should be realized that the present invention is not limited to the embodiments described hereinabove and illustrated in the drawings. For instance, although the submersible pump in the illustrated embodiments have been illustrated to be used in connection with a marine structure, such as a semi-submersible unit, the submersible pump may also be used in other appliances in which a liquid is to be pumped using a submersible pump. Moreover, a tube may for instance be differently shaped as compared to the tubes discussed hereinabove. Instead of being straight a tube may for instance extend straight down through a column and at its end have a 90 degree angle extending laterally through a hull. In a tube two or more pumps may be arranged. Two tubes may be in fluid communication with each other. As such, a person skilled in the art will realize that changes and modifications may be performed within the scope of the appended claims.

The invention claimed is:

1. A submersible pump for pumping liquid into a marine structure, said pump being adapted to be located in a tube, said pump comprising:

an upper portion and a lower portion wherein said upper portion is adapted to be connected to a means for suspending said pump in said tube;

a vertical direction extending from said lower portion to said upper portion;

an inlet for allowing said liquid into said pump, wherein said inlet is disposed in an end of said lower portion;

an outlet for allowing said liquid out of said pump, wherein said outlet is disposed on around a circumference of said pump; and a sealing means located downstream of said inlet and said outlet in said vertical direction, said sealing means being adapted to seal against an inner surface of said tube in the event of a free fall of said pump; and a shock absorber being adapted to cushion a landing of said pump at a pumping location, wherein:

said pump is adapted to be locked from rotation in said pumping location by means of a locking arrangement, a first portion of said locking arrangement being connected to said tube at said pumping location and a second portion of said locking arrangement being connected to said pump, and said second portion of said locking arrangement comprises a metal sheet arranged between said shock absorber and said pump and along said periphery of said pump, said metal sheet having an arrangement of downwardly inclined resilient lugs.

2. The submersible pump according to claim 1, wherein said sealing means is a radial flange.

3. The submersible pump according to claim 1, wherein said sealing means is connected to said pump by means of a radial spring adapted to provide a resilient seal against said inner surface of said tube.

4. The submersible pump according to claim 1, wherein said sealing means is provided with a downwardly oriented sleeve.

5. The submersible pump according to claim 4, wherein an angle between said pump and said sleeve is between 10° to 45°.

6. The submersible pump according to claim 1, wherein said outlet for allowing said liquid out of said pump is a radial outlet.

7. The system according to claim 1, wherein the shock absorber comprises a copper alloy.

8. A submersible pump system, comprising:

a submersible pump for pumping liquid to a marine structure, said pump being adapted to be located in a tube adapted to transport said pump to and from a submerged pumping location, said pump comprising:

an upper portion and a lower portion wherein said upper portion is adapted to be connected to means for suspending said pump in said tube;

a vertical direction extending from said lower portion to said upper portion;

an inlet for allowing said liquid into said pump, wherein said inlet is disposed in an end of said lower portion;

an outlet for allowing said liquid out of said pump, wherein said outlet is disposed on around a circumference of said pump;

a sealing means located downstream of said inlet and said outlet in said vertical direction, said sealing means being adapted to seal against an inner surface of said tube in the event of a free fall of said pump, wherein:

a by-pass means is adapted to be arranged around said lower portion of said pump at said pumping location, said by-pass means is adapted to allow said liquid provided from said outlet to pass said sealing means for further transport of said liquid, and wherein said by-pass means is provided in said tube, whereby said tube at said pumping location has an inner diameter greater than said inner diameter of said tube portion above said pumping location to allow the flow of pumped liquid to by pass said sealing means in a by-pass chamber.

9. The system according to claim 8, wherein said pump further comprises a shock absorber being adapted to cushion a landing of said pump at said pumping location.

10. The system according to claim 8, wherein said tube further comprises a tube bottom plate being adapted to receive said pump in said pumping location.

11. The system according to claim 9, wherein the shock absorber comprises a copper alloy.

12. The system according to claim 11, wherein said first portion of said locking arrangement comprises an arrangement of upwardly directed lumps, said arrangement of upwardly directed lumps being connected to said tube.

13. The system according to claim 8, wherein the by-pass means is a built-on chamber attached to the outside of the tube at the pumping location, whereby the tube has a at least one opening for letting liquid out into said built-on chamber.

14. The system according to claim 13, wherein said marine structure comprises a bottom, wherein the built-on chamber is attached to the outside of the tube and below the bottom of the marine structure.

15. The system according to claim 8, wherein the tube is adapted to transport the pumped liquid from said pumping location up through the tube.

16. The system according to claim 8, wherein the system further comprises a lifting and lowering arrangement for transporting the pump to and from the pumping location.

17. The system according to claim 16, wherein the lifting and lowering arrangement comprises at least one lifting means connected to said upper portion of the pump and connected to a winch for transporting the pump up and down in the tube.

18. The system according to claim 16, wherein the lifting and lowering arrangement further comprises a control cable connected to the upper portion of the pump, said control cable houses an electrical cable for providing power to the pump.

19. The system according to claim 16, wherein the lifting and lowering arrangement is installed in a pump room on board the marine structure.

20. The system according to claim 8, wherein said outlet is adapted to allow said liquid out of said pump to an environment ambient said pump.

21. A submersible pump system, comprising:

a submersible pump for pumping liquid to a marine structure, said pump being adapted to be located in a tube adapted to transport said pump to and from a submerged pumping location in the marine structure, said pump comprising:

an upper portion and a lower portion wherein said upper portion is adapted to be connected to means for suspending said pump in said tube;

a vertical direction extending from said lower portion to said upper portion;

an inlet for allowing said liquid into the pump;

an outlet for allowing said liquid out of the pump;

a sealing means located downstream of said inlet and said outlet in said vertical direction, said sealing means being adapted to seal against an inner surface of said tube in the event of a free fall of the pump; and a shock absorber being adapted to cushion a landing of the pump at the pumping location, wherein:

said pump is adapted to be locked from rotation in the pumping location by means of a locking arrangement, a first portion of said locking arrangement being connected to said tube at said pumping location and a second portion of said locking arrangement being connected to said pump, and said second portion of said locking arrangement comprises a metal sheet arranged between the shock absorber and the pump and along the periphery of the pump, said metal sheet having an arrangement of downwardly inclined resilient lugs.

22. A submersible pump system, comprising:

a submersible pump for pumping liquid to a marine structure, said pump being adapted to be located in a tube adapted to transport said pump to and from a submerged pumping location in the marine structure, said pump comprising:

an upper portion and a lower portion wherein said upper portion is adapted to be connected to means for suspending said pump in said tube;

a vertical direction extending from said lower portion to said upper portion;

an inlet for allowing said liquid into the pump;

an outlet for allowing said liquid out of the pump; and a sealing means located downstream of said inlet and said outlet in said vertical direction, said sealing means being adapted to seal against an inner surface of said tube in the event of a free fall of the pump, wherein:

a by-pass means is adapted to be arranged around said lower portion of the pump at said pumping location, said by-pass means is adapted to allow the liquid provided from said outlet to pass the sealing means for further transport of said liquid, and wherein the by-pass means is provided in the tube, whereby the tube at the pumping location has an inner diameter greater than the inner diameter of the tube portion above the pumping location to allow the flow of pumped liquid to by pass the sealing means in a by-pass chamber.

* * * * *